US005166737A

United States Patent [19]

Tomita

[11] Patent Number: 5,166,737

[45] Date of Patent: Nov. 24, 1992

[54] TRANSPORT GUIDE MEMBER FOR GUIDING TRANSFER SHEETS

[75] Inventor: Junko Tomita, Tokyo, Japan

[73] Assignee: Ricoh Company, Ltd., Tokyo, Japan

[21] Appl. No.: 561,674

[22] Filed: Aug. 1, 1990

[30] Foreign Application Priority Data

Aug. 9, 1989 [JP] Japan ..... 1-92950[U]
Dec. 18, 1989 [JP] Japan ..... 1-144900[U]
Jul. 6, 1990 [JP] Japan ..... 2-177521

[51] Int. Cl.[5] ..... G03G 21/00
[52] U.S. Cl. ..... 355/308; 355/309
[58] Field of Search ..... 355/308, 309, 271, 311, 355/282, 273

[56] References Cited

U.S. PATENT DOCUMENTS 4,369,729 1/1983 Shigenobu et al. ..... 355/271 X
4,408,863 10/1983 Ogata et al. ..... 355/271
4,511,238 4/1985 Hori ..... 355/271
4,843,214 6/1989 Higashi et al. ..... 355/309 X
4,862,215 8/1989 Nomura et al. ..... 355/309
4,939,550 7/1990 Takeda et al. ..... 355/282

*Primary Examiner*—A. T. Grimley
*Assistant Examiner*—Matthew S. Smith
*Attorney, Agent, or Firm*—Cooper & Dunham

[57] ABSTRACT

A transport guide member for transporting a toner-image-bearing transfer sheet to an image-fixing unit with the image-bearing side up thereon, comprising a grounded slide-contact layer having a volume resistivity of $10^6$ to $10^{13}$ Ω·cm, along which the above-mentioned transfer sheet is transported with the back side thereof opposite to the image-bearing side thereof being in contact therewith.

2 Claims, 4 Drawing Sheets

TRANSPORT GUIDE MEMBER FOR GUIDING TRANSFER SHEETS

BACKGROUND OF THE INVENTION

1. Field of the Invention

This invention relates to a transport guide member for transporting transfer sheets, and more particularly to a transport guide member for transporting toner-image-bearing transfer sheets to an image fixing unit with the back side thereof in contact with the transport guide member after a series of processes in which latent electrostatic images formed on a photoconductor in an electrophotographic copying apparatus are developed to visible toner images, the visible toner images are transferred to the surface of the above-mentioned transfer sheet, and the transfer sheet is separated from the photoconductor.

2. Discussion of Background

In an image formation apparatus in which an electrophotographic process is carried out in practice, such as an electrophotographic copying apparatus, a laser printer or a facsimile apparatus, a main charger 2, a light-image writing system 3, a development unit 4 and a transfer charger 5 are positioned around a photoconductor 1 in the sequence of the image formation processes along the rotational direction of the photoconductor 1, as shown in FIG. 1.

The outer surface of the photoconductor 1 is uniformly charged to a predetermined polarity by the main charger 2 and exposed to light images by using the light-image writing system 3, so that latent electrostatic images are formed on the photoconductor 1. The thus formed latent electrostatic images are developed to visible toner images using a developer supplied from a development unit 4. These toner images are transferred to a transfer sheet 6 by the aid of the transfer charger 5, and this transfer sheet is sent to an image-transfer section between the photoconductor 1 and the transfer charger 5. The transfer sheet 6 which bears the toner images is separated from the surface of the photoconductor 1 and transported to an image fixing unit 7, in which the toner images are fixed to the transfer sheet 6 and the image formation is finally achieved.

Japanese Laid-Open Patent Application 62-153865 discloses a transport guide member 8, as shown in FIG. 1, which is one of the means for transporting the toner-image-bearing transfer sheet 6 to the image fixing unit 7 after the transfer sheet 6 has been separated from the photoconductor 1. In this disclosure, the image-bearing transfer sheet 6 is carried to the image fixing unit 7 along the above-mentioned transport guide member, with the back side thereof in contact with the transport guide member.

In the course of an image-transfer operation, the transfer sheet is sufficiently charged with positive electric charges by the application of positive electric charges to the back side of the transfer sheet by a transfer charger, for example, a corona charger. The negatively charged toner images formed on the photoconductor are thus attracted to the positively charged transfer sheet, whereby the toner images are transferred to the transfer sheet.

When the transfer sheet employed for the image formation has a low resistivity, the positive electric charges which are imparted to the transfer sheet by the transfer charger are dissipated in the horizontal direction in the transfer sheet. Therefore, the quantity of the positive electrical charge which functions to attract the negatively charged toner is decreased, so that toner images formed on the photoconductor are not adequately transferred to the transfer sheet.

In the case where the resistivity of the transfer sheet is within an optimum range, the positive electric charges which are imparted to the back side of the transfer sheet by the transfer charger are moved toward the surface thereof. As a result, the negatively charged toner particles are electrostatically attracted to the positive electric charges on the surface of the transfer sheet, and the toner images are satisfactorily transferred to the transfer sheet.

When the transfer sheet has a high resistivity, positive electric charges provided by the transfer charger accumulate on the back side of the transfer sheet, without moving toward the surface thereof. Thus, the electrostatic attraction force between the toner particles and the transfer sheet remains small, and the transfer sheet is sent to the image-fixing unit, with the positive electric charges remaining on the back side thereof.

The above-mentioned problem of the residual electric charges remaining on the back side of the transfer sheet is particularly observed in a small-size or low-price electrophotographic copying apparatus in which a quenching system for the transfer sheet is not provided or in which a special unit such as a quenching needle is not provided.

When a large quantity of the positive electric charge remains on the back side of the transfer sheet, the positive electric charges are easily discharged at a small gap between the transfer sheet and the transport guide member. This interrupts the image formation, and causes a blurring of the toner images formed on the transfer sheet. In particular, when the diameter of the photoconductor employed in the electrophotographic apparatus is so small that the transfer sheet is separated therefrom with a large curvature, and there is no process for quenching the electric charge of the transfer sheet in the apparatus, the quantity of electric charge is increased and the toner images formed on the transfer sheet easily deteriorate.

The above-mentioned discharging of the positive electric charges at a small gap between the transfer sheet and the transport guide member takes place depending on (i) the quantity of the positive electric charge remaining on the back side of the transfer sheet, (ii) the potential of the surface of the transport guide member and (iii) the distance between the transfer sheet and the transport guide member. Although the relationship among the above-mentioned three factors has been explained by the Paschen's law, the distance between the transfer sheet and the transport guide member is usually too small to be controlled and cannot be made constant since the transfer sheet is transported in contact with the transport guide member.

SUMMARY OF THE INVENTION

Accordingly, an object of this invention is to provide a transport guide member, capable of transporting a toner-image-bearing transfer sheet to an image-fixing unit without causing the discharge of electric charges which have been imparted to the transfer sheet, and without causing a blurring of the toner images formed on the transfer sheet.

The above-mentioned object of the present invention can be achieved by a transport guide member for transporting a toner-image-bearing transfer sheet with the image-bearing side up thereon, comprising a grounded slide-contact layer with a volume resistivity of $10^6$ to $10^{13}$ Ω·cm, along which the transfer sheet is transported with the back side thereof opposite to the image-bearing side thereof being in contact therewith.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF PREFERRED EMBODIMENTS

According to the present invention, the transport guide member for transporting a toner-image-bearing transfer sheet comprises a slide-contact layer, which is in contact with the back side of the transfer sheet, is grounded and has a volume resistivity of $10^6$ to $10^{13}$ Ω·cm.

In the present invention, the transport guide member may be constructed in such a fashion that a slide-contact layer having a volume resistivity of $10^6$ to $10^{13}$ Ω·cm is formed on a substrate, through which the above-mentioned slide-contact layer is grounded. In this case, the substrate comprises an electroconductive material or a resin. The substrate preferably comprises an electroconductive material.

Since the transport guide member according to the present invention comprises the grounded slide-contact layer having a volume resistivity of $10^6$ to $10^{13}$ Ω·cm, positive electric charges which have been imparted to a transfer sheet by a transfer charger are gradually dissipated through the slide-contact layer of the transport guide member while the transfer sheet slides to an image-fixing unit along the transport guide member. In this case, positive electric charges do not extremely accumulate in the transport guide member. This prevents a blurring of the toner images formed on the transfer sheet due to the residual positive electric charge of the transfer sheet. The slide-contact layer of the transport guide member for use in the present invention has a volume resistivity of $10^6$ to $10^{13}$ Ω·cm, which helps the charge quenching of the transfer sheet and prevents the occurrence of discharge from the transfer sheet.

Furthermore, when the slide-contact layer is grounded, the electrostatic attraction force between the positively charged transfer sheet and the transport guide member is strongly maintained. Accordingly, the transfer sheet is carried along the transport guide member further steadily without floating over the transport guide member and without causing paper jam.

In addition to the above, it is preferable that the above-mentioned slide-contact layer of the transport guide member according to the present invention have a surface resistivity of $10^6$ to $10^{13}$ Ω·cm.

Prior to the explanation of examples of a transport guide member according to the present invention, the optimal volume resistivity of the slide-contact layer of the transport guide member, which is in contact with the back side of the toner-image-bearing transfer sheet, will now be explained with reference to FIG. 7, based on experiments conducted by the inventor of the present invention.

Figure 7:
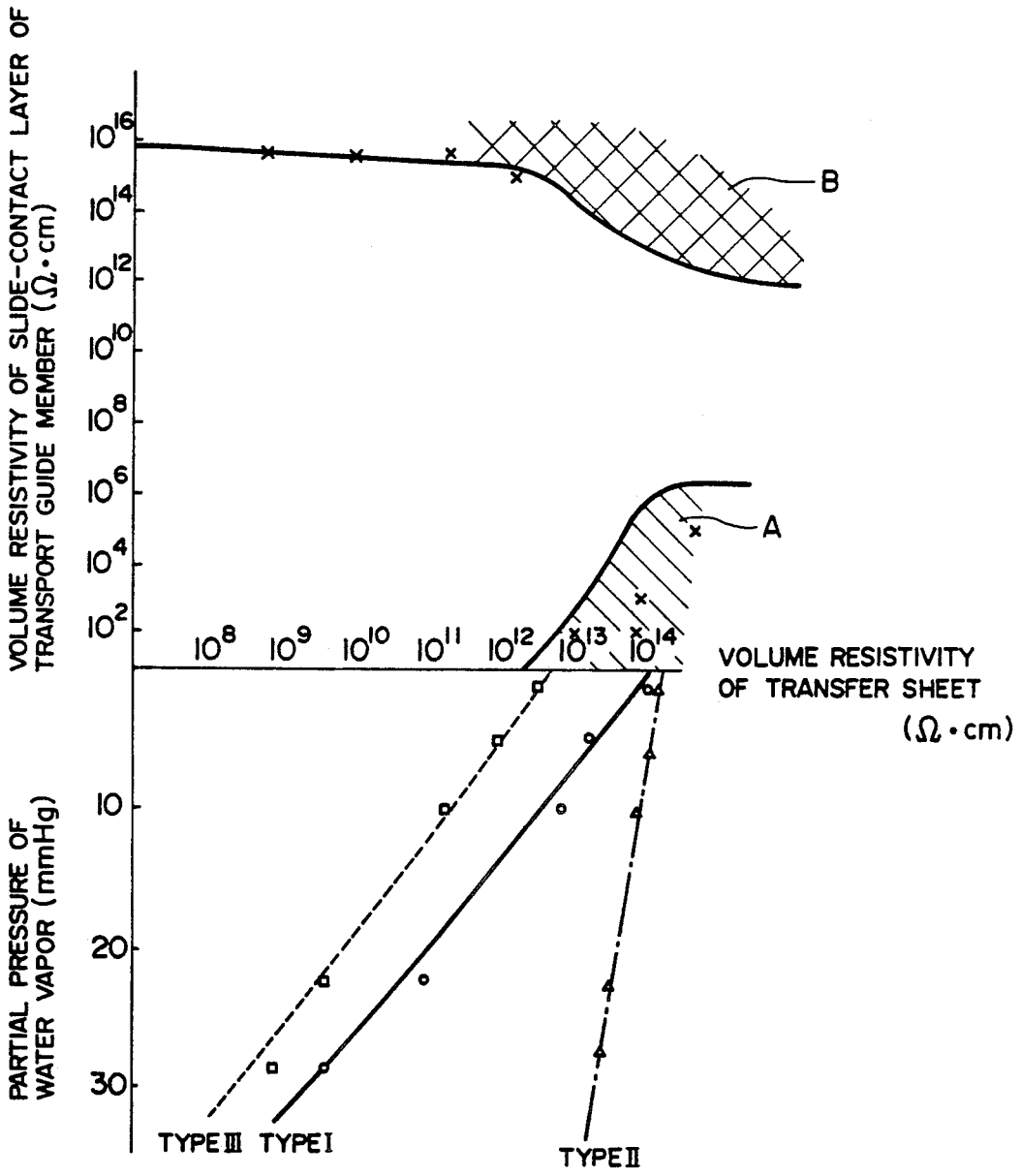
FIG. 7 is a graph showing the relationship among the volume resistivity of a transfer sheet, the volume resistivity of a slide-contact layer of a transport guide member, and the occurrence of the image blurring on the transfer sheet.

The upper part of the graph in FIG. 7 shows the relationship among the volume resistivity of a transfer sheet, the volume resistivity of a slide-contact layer of a transport guide member according to the present invention, and the occurrence of image blur on the transfer sheet.

As apparent from the graph shown in FIG. 7, the image blur appears on the transfer sheet when the transfer sheet has a high volume resistivity and the slide-contact layer of the transport guide member has a low volume resistivity as indicated by shaded Area A, and when the transfer sheet has a high volume resistivity and the slide-contact layer of the transport guide member also has a high volume resistivity as indicated by shaded Area B.

More specifically, when the volume resistivity of the transfer sheet is $10^{12}$ Ω·cm or less the quantity of electric charge provided to the back side of the toner-image-bearing transfer sheet by the transfer charger is decreased to about $0.1\times10^{-4}$ C/m$^2$ or less because the electric charge is dissipated in the horizontal direction in the transfer sheet or passed therethrough, as previously mentioned. Thus, the electric charge is not discharged in this case.

Figure 4:
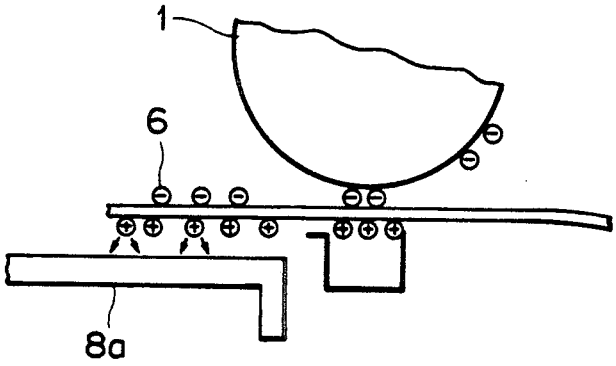
FIG. 4 PRIOR ART
FIGS. 4 and 5 are schematic diagrams in explanation of the problems caused by conventional transport guide members.

When the volume resistivity of the transfer sheet is $10^{13}$ Ω·cm or more and the transfer sheet is charged with a positive electric charge of +6 kV by the transfer charger and a positive current of +25 μA in terms of counter grounded-drum current, the back side of the transfer sheet is charged with an electric charge of about $0.2\times10^{-4}$ C/m$^2$. In the above case, when a transport guide member 8*a* made of an electroconductive metal, with a volume resistivity of $10^2$ Ω·cm or less is used as shown in FIG. 4, the electric charges at the back side of the transfer sheet 6 are discharged toward the transport guide member 8*a* when the gap between the transfer sheet 6 and the transport guide member 8*a* becomes very small after the transfer sheet 6 is moved to the transport guide member 8*a*. The discharging of electric charges from the transfer sheet 6 interrupts the image-transfer operation of the unfixed toner images on the transfer sheet 6. In the case where the transfer sheet 6 is positively charged by the transfer charger, the positive electric charges are discharged from the back side of the transfer sheet 6 in the shape of a circle or an ellipse. Thus, the blurring of the toner images also appears circularly or elliptically on the transfer sheet 6.

Even though the quantity of the electric charge is about $0.2\times10^{-4}$ C/m$^2$ at the back side of the transfer sheet, the discharging of positive electric charges does not take place circularly or elliptically when the slide-contact layer of the transport guide member, which is in slide contact with the back side of the transfer sheet, has a volume resistivity of $10^3$ Ω·cm or more. In this case, the positive electric charges are gradually dissipated through the slide-contact layer of the transport guide member in the grounded direction, in accordance with the resistivity of the slide-contact layer.

Figure 5:
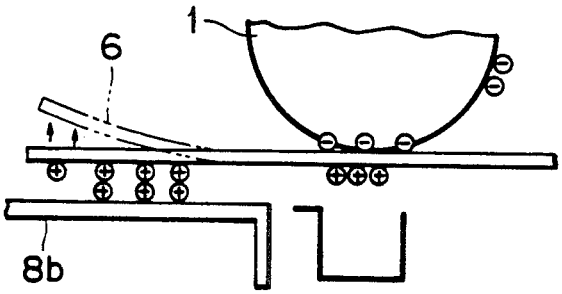
FIG. 5 PRIOR ART

However, when the slide-contact layer of the transport guide member has a volume resistivity of $10^4$ Ω·cm or more, the quantity of the positive electric charge is increased at the back side of the transfer sheet, which is shown as a transport guide member 8*b* in FIG. 5, because the back side of the transfer sheet 6 is brought into slide contact with the slide-contact layer of the transport guide member 8*b* while the transfer sheet 6 is moved along the transport guide member 8*b*. As a result, the quantity of the electric charge attains to $0.2\times10^{-4}$ C/m$^2$ or more. The positive electric charges thus accumulated at the back side of the transfer sheet 6 are discharged to the slide-contact layer with a high volume resistivity of the transport guide member 8*b*. The quantity of the discharged electric charge is more than that in the above-mentioned case where the transport guide member has a volume resistivity of $10^2$ Ω·cm or less, so that the discharging takes place in the shape of a larger circle or ellipse. This increases the area subjected to the image blurring.

Figure 6:
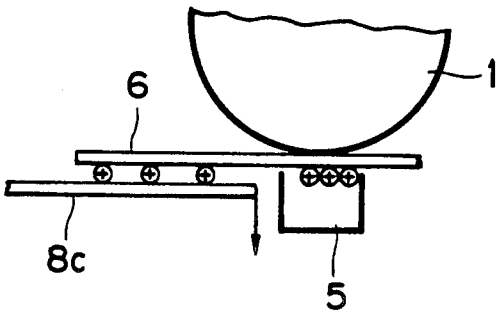
FIG. 6 is a schematic diagram in explanation of the effects caused by a transport guide member for transporting a transfer sheet according to the present invention.

In contrast to the above, when the volume resistivity of the transfer sheet is $10^{13}$ Ω·cm and that of the slide contact layer of the transport guide member is in the range of $10^6$ to $10^{13}$ Ω·cm, which transport guide member is shown as a transport guide member 8*c* in FIG. 6, the positive electric charge scarcely accumulate at the back side of the transfer sheet 6 when the transfer sheet 6 is brought into slide contact with the transport guide member 8*c* as shown in FIG. 6. While the transfer sheet 6 is moved along the transport guide member 8*c*, the positive electric charges at the back side of the transfer sheet 6 are gradually discharged. Thus, the transfer sheet 6 reaches the image-fixing unit. In this case, the electric charges do not accumulate in the transport guide member, so that the image blurring can be avoided.

When the volume resistivity of the transfer sheet is more than $10^{13}$ Ω·cm, the quantity of the electric charge is further increased at the back side of the transfer sheet. Accordingly, the selection of an appropriate transport guide member is restricted because the range of the volume resistivity of the transport guide member which does not cause a blurring in the toner images when used together with the transfer sheet becomes very small as shown in FIG. 7.

In addition to the above, the volume resistivity of the transfer sheet varies depending on the environmental moisture. The lower part of the graph in FIG. 7 shows the relationship between the partial pressure (mmHg) of water vapor in the atmosphere and the volume resistivity (Ω·cm) of the transfer sheet. In general, as the partial pressure of water vapor, that is, the absolute humidity, is lowered, the volume resistivity of the transfer sheet is increased.

In FIG. 7, a transfer sheet (Type I) is a commercially available sheet, "Ricoh type 6200" (Trademark), made by Ricoh Company, Ltd. The volume resistivity of the transfer sheet (Type I) is $10^{13}$ Ω·cm or more when the partial pressure of water vapor is 10 mmHg or less. There is a possibility of the occurrence of a blurring in the toner images on the transfer sheet in the image-transfer operation.

A transfer sheet (Type II) is a transparent sheet for an over head projector (OHP). Regardless of the partial pressure of water vapor, the volume resistivity of the transfer sheet (Type II) is always as high as $10^{13}$ Ω·cm or more.

A transfer sheet (Type III) contains a large amount of a filler, so that it shows a relatively small volume resistivity.

In the electrophotographic copying apparatus, not only a plain transfer sheet (copy paper) and a cotton paper, but also a transparent sheet for the OHP is increasingly utilized. According to the present invention, the transport guide member comprising a grounded slide-contact layer having a volume resistivity of $10^6$ to $10^{13}$ Ω·cm can be used to cope with the transfer sheet having a high volume resistivity.

In the present invention, it is preferable that the slide-contact layer of the transport guide member have a surface resistivity of $10^6$ to $10^{13}$ Ω·cm.

Examples of the present invention will now be explained in detail by referring to FIGS. 2 to 3.

Figure 1:
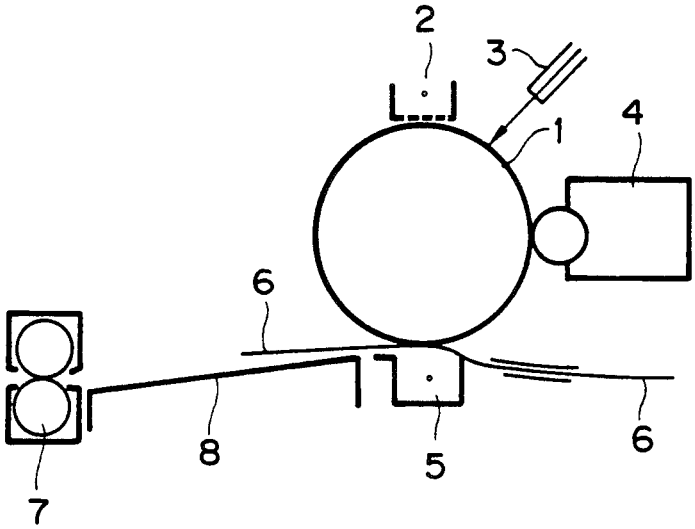
FIG. 1 PRIOR ART
FIG. 1 is a schematic cross-sectional view of a photoconductor and an image fixing unit in a conventional image formation apparatus equipped with a transport guide member for a transfer sheet according to the present invention.
Figure 2:
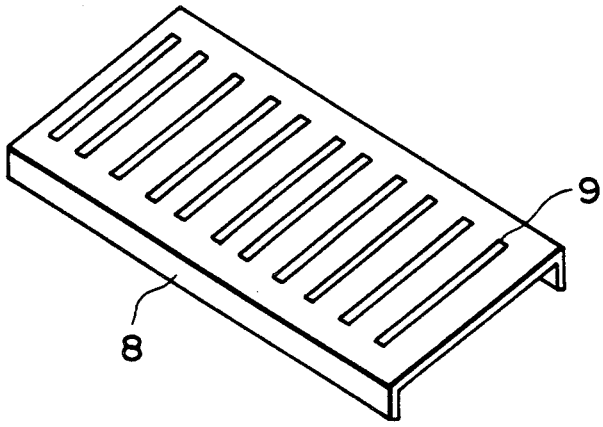
FIG. 2 is a perspective view of an example of a transport guide member for transporting a toner-image-bearing transfer sheet according to the present invention.
Figure 3A:
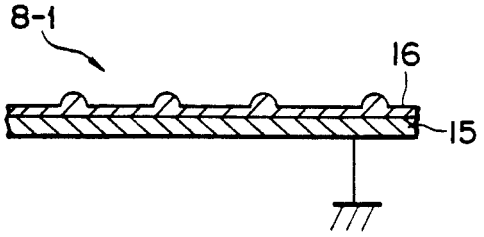
FIGS. 3(*a*) to 3(*e*) are schematic cross-sectional views of other examples of the transport guide member for transporting a toner-image-bearing transfer sheet according to the present invention.
Figure 3B:
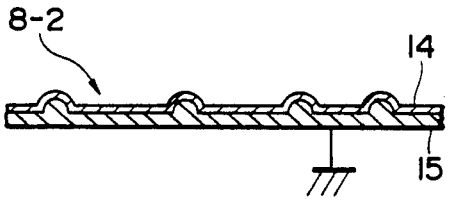
Figure 3C:
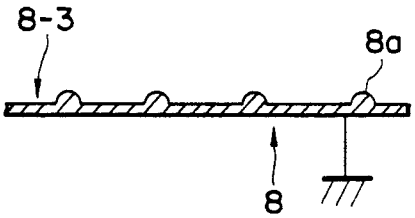
Figure 3D:
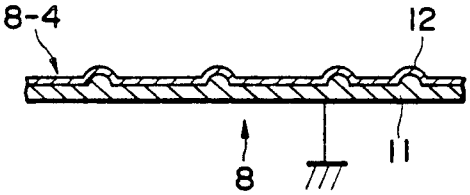
Figure 3E:
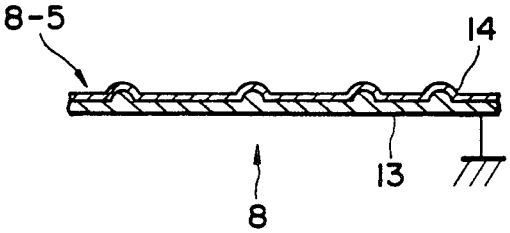

FIG. 2 is a perspective view of a transport guide member for transporting a toner-image-bearing transfer sheet according to the present invention. In FIG. 2, a plurality of ribs 9 are protruded on the outer surface of the transport guide member 8 which comes in slide contact with the back side of a transfer sheet, in the direction perpendicular to the transport direction of the transfer sheet.

FIG. 3(*a*) is a schematic cross-sectional view of a first example of the transport guide member according to the present invention. The appearance of the transport guide member shown in FIG. 3(*a*) is the same as that illustrated in FIG. 2. In FIG. 3(*a*), a transport guide member 8-1 is prepared by molding a slide-contact layer 16 having a volume resistivity of $10^6$ to $10^{13}$ Ω·cm on a metallic substrate 15. The slide-contact layer 16 is grounded through the substrate 15. As the material for the slide-contact layer 16, for instance, a commercially available resin, "Polymer alloy type ABS antistatic resin", made by Toray Industries, Inc., which has a volume resistivity of $10^6$ to $10^{13}$ Ω·cm itself, can be employed.

FIG. 3(*b*) is a schematic cross-sectional view of a second example of the transport guide member according to the present invention, which is referred to as a transport guide member 8-2. In FIG. 3(*b*), a slide-contact layer 14 is formed on a metallic substrate 15 having a plurality of ribs by coating a coating compound having a volume resistivity of $10^6$ to $10^{13}$ Ω·cm. This slide-contact layer 14 is also grounded through the substrate 15. As the coating compound for the slide-contact layer 14, general antistatic grade coating compounds in which a carbon is dispersed can be used.

FIG. 3(*c*) is a schematic cross-sectional view of a third example of the transport guide member according to the present invention, which is referred to as a transport guide member 8-3. The appearance of the transport guide member shown in FIG. 3(*c*) is the same as that illustrated in FIG. 2. The transport guide member 8-3 comprises a self-supporting slide-contact layer having a surface resistivity of $10^6$ to $10^{13}$ Ω·cm, which is grounded. As the material for the above-mentioned self-supporting slide-contact layer, for instance, a commercially available resin, "Polymer alloy type ABS antistatic resin", made by Toray Industries, Inc., can be employed.

FIG. 3(*d*) is a schematic cross-sectional view of a fourth example of the transport guide member according to the present invention, which is referred to as a transport guide member 8-4. In FIG. 3(*d*), a slide-contact layer 12 having a surface resistivity of $10^6$ to $10^{13}$ Ω·cm is formed on a substrate 11 comprising a resin. In FIG. 3(*d*), the slide-contact layer 12 is formed by use of a commercially available antistatic PET, "Acrypet" (Trademark), made by Mitsubishi Rayon Co., Ltd., or "Emblet" (Trademark), made by Unitika Ltd.

FIG. 3(*e*) is a schematic cross-sectional view of a fifth example of the transport guide member according to the present invention, which is referred to as a transport guide member 8-5. In FIG. 3(*e*), the transport guide member 8-5 comprises an electroconductive substrate 13 and a slide-contact layer 14, formed thereon. The slide-contact layer 14 can be formed on the substrate 13 by applying a conventional antistatic grade coating compound having a surface resistivity of $10^6$ to $10^{13}$ Ω·cm. The slide-contact layer 14 is grounded through the electroconductive substrate 13.

Furthermore, when the slide-contact layer in FIGS. 3(*a*) to 3(*e*) comprises a material having a charging voltage of 300 V or less and a charging voltage half-value period of 1 sec or less, the charge quenching of the transfer sheet can be remarkably improved and the discharging from the transfer sheet can be effectively prevented.

The above-mentioned charging voltage and half-value period thereof were measured by "Static honestmeter" (Trademark), made by Shishido Electrostatic Ltd., under the following conditions:

| | |
|---|---|
| Applied voltage: | 8000 V (−) |
| Distance between samples to which an electric voltage is applied: | 10 mm |
| Time for application of electric voltage: | 60 sec. |

-continued

| | |
|---|---|
| Distance between samples and detection electrode: | 5 mm |

It is preferable that the friction coefficient between the transfer sheet and the slide-contact layer of the transport guide member be decreased to 0.5 or less in order to minimize the accumulation of electric charges therebetween due to the contact and friction.

As previously explained, when the transport guide member for transporting a toner-image-bearing transfer sheet comprises a grounded slide-contact layer having a volume resistivity of $10^6$ to $10^{13}$ Ω·cm, electrostatic problems which occur between the transfer sheet and the transport guide member can be eliminated, thereby forming high quality toner images on the transfer sheet without blurring.

Furthermore, since the slide-contact layer of the transport guide member according to the present invention is grounded, the transport of the transfer sheet can be ensured without causing paper jam due to the unfavorable electrostatic attraction force between the transfer sheet and the transport guide member.

What is claimed is:

1. A transport guide member for transporting a toner-image-bearing transfer sheet with the image-bearing side up thereon comprising:

a slide-contact layer which is grounded and has a volume resistively of $10^6$ to $10^{13}$ Ω·cm, along which said transfer sheet is transported with the back side thereof opposite to the image-bearing side thereof being in contact therewith, said slide-contact layer having a charging voltage of 300 V or less and a charging voltage half-value period of 1 sec or less.

2. A transport guide member for transporting a toner-image-bearing transfer sheet with the image-bearing side up thereon comprising:

a slide-contact layer which is grounded and has a volume resistively of $10^6$ to $10^{13}$ Ω·cm, along which said transfer sheet is transported with the back side thereof opposite to the image-bearing side thereof being in contact therewith; and a substrate comprising an electroconductive material on which said slide-contact layer is provided, and through which said slide-contact layer is grounded.

* * * * *